US006843023B2

(12) United States Patent
Liu

(10) Patent No.: US 6,843,023 B2
(45) Date of Patent: Jan. 18, 2005

(54) DUAL CASEMENT WINDOW STRUCTURE

(76) Inventor: Jin Huo Liu, P.O. Box 26-757, Taipei (TW), 106

( * ) Notice: Subject to any disclaimer, the term of this patent is extended or adjusted under 35 U.S.C. 154(b) by 0 days.

(21) Appl. No.: 10/327,550

(22) Filed: Dec. 19, 2002

(65) Prior Publication Data

US 2004/0118050 A1 Jun. 24, 2004

(51) Int. Cl.[7] ..... E05D 15/00; E05D 15/48

(52) U.S. Cl. ..... 49/143; 49/163; 52/204.51; 292/DIG. 20

(58) Field of Search ..... 49/339, 345, 346, 49/143, 142, 145, 163, 406; 160/90; 292/240, 241, DIG. 47, DIG. 20; 52/204.66, 202, 204.62, 204.5, 204.51, 204.593, 204.6, 656.5

(56) References Cited

U.S. PATENT DOCUMENTS 2,852,816 A * 9/1958 Spretnjak et al. ..... 49/143
2,877,840 A * 3/1959 Hurowitz et al. ..... 160/91
3,093,224 A * 6/1963 Wilson ..... 292/241
4,768,316 A * 9/1988 Haas ..... 52/204.51
5,274,955 A * 1/1994 Dallaire et al. ..... 49/406
5,398,446 A * 3/1995 Kunert ..... 49/169
5,832,666 A * 11/1998 Flack et al. ..... 49/67
5,836,111 A * 11/1998 Tak ..... 49/425
5,996,285 A * 12/1999 Guillemet et al. ..... 49/213
6,098,355 A * 8/2000 Li ..... 52/204.56
6,481,159 B2 * 11/2002 Diston ..... 49/142

* cited by examiner

*Primary Examiner*—Hugh B. Thompson, II
(74) *Attorney, Agent, or Firm*—Apex Juris, pllc; Tracy M. Helms

(57) ABSTRACT

A dual casement window structure includes a frame, a casement window, an outward opening window leaf and a latch mechanism. The frame is mounted in a wall of the room, and is provided with rails. The casement window is movably attached on the casement frame in a manner to slide along the rails. The casement window has a mounting section on its outer side where is mounted the outwardly opening window leaf. The outward opening window leaf has a plurality of supporting means to support the outward opening window leaf when the outward opening window leaf is pushed outwardly. A hinge is further mounted at an upper portion of the outward opening window leaf to pivotally connect to the casement window.

6 Claims, 8 Drawing Sheets

DUAL CASEMENT WINDOW STRUCTURE

BACKGROUND OF THE INVENTION

1. Field of the Invention

The invention relates to a dual casement window structure. More particularly, the invention relates to an aesthetic dual casement window structure with a good sheltering from rainwater and good ventilation.

2. Description of the Related Art

Referring to FIG. 1, a conventional casement window 1 is movably attached on three parallel rails 13*a* in a frame 1*a*. More specifically, a screen window 10*a*, an inner casement window 11*a* and an outer casement window 12*a* are movably attached on the rails 13*a* to slide along the rails 13*a*. However, during rainy days, rainwater easily penetrates the room through gaps between the components of the conventional casement window because there is not sheltering outside the casement window. If the casement window is closed to prevent rainwater penetration, an air conditioner has to be turned on to maintain a good ventilation of the room, which results in a wasteful energy consumption. Furthermore, the cooling medium used in the air conditioner is also consumed in a great amount, which detrimental to the environmental protection.

Referring to FIG. 2, a conventional pivotably casement window includes a frame 2*a* mounted on a wall, and a pivotably window leaf 20*a* mounted inside the frame 2*a*. During rainy days, the pivotably window leaf 20*a* is pushed outwardly to achieve a good ventilation and prevent rainwater penetration. However, in consideration of good ventilation, the performance of the pivotably window leaf is not as good as that of the casement window. Furthermore, the pivotably window leaf 20*a* is pivotally connected to the frame 2*a*, and therefore cannot be dismounted from the frame 2*a* for cleaning. The only way to clean the pivotably casement window for a user is therefore to stand as high as the pivotably casement window, which may be dangerous.

An additional canopy may be further mounted above the casement window to shelter from rainwater. However, the installation of the canopy is not handy, and shapes and colors of the canopy may not match with the perspective of the building. Therefore, there is a need of an aesthetic casement window with good rainwater sheltering and ventilation effects.

SUMMARY OF THE INVENTION

It is therefore an object of the invention to provide a dual casement window structure that includes a frame, a casement window, an outward opening window leaf and a latch mechanism. The frame in mounted in a wall and is provided with rails. The casement window is movably attached on the casement frame in a manner to slide along the rails. The casement window has a mounting section on its outer side where is mounted the outward opening window leaf. The outward opening window leaf has a plurality of supporting means to support the outward opening window leaf when the outward opening window leaf is pushed outwardly. A hinge is further mounted at an upper portion of the outward opening window leaf to pivotally connect to the casement window. The supporting means and the hinge allow the outward opening window leaf to be outwardly opened from the casement window. Sliding the casement window along the rails of the frame and outwardly opening the outwardly opening window leaf can be individually achieved as desired, thereby providing good rain sheltering and good ventilation effects.

BRIEF DESCRIPTION OF THE DRAWINGS

The drawings included herein provide a further understanding of the invention and, incorporated herein, constitute a part of the invention disclosure. A brief introduction of the drawings is as follows.

DESCRIPTION OF THE PREFERRED EMBODIMENTS

Figure 1:
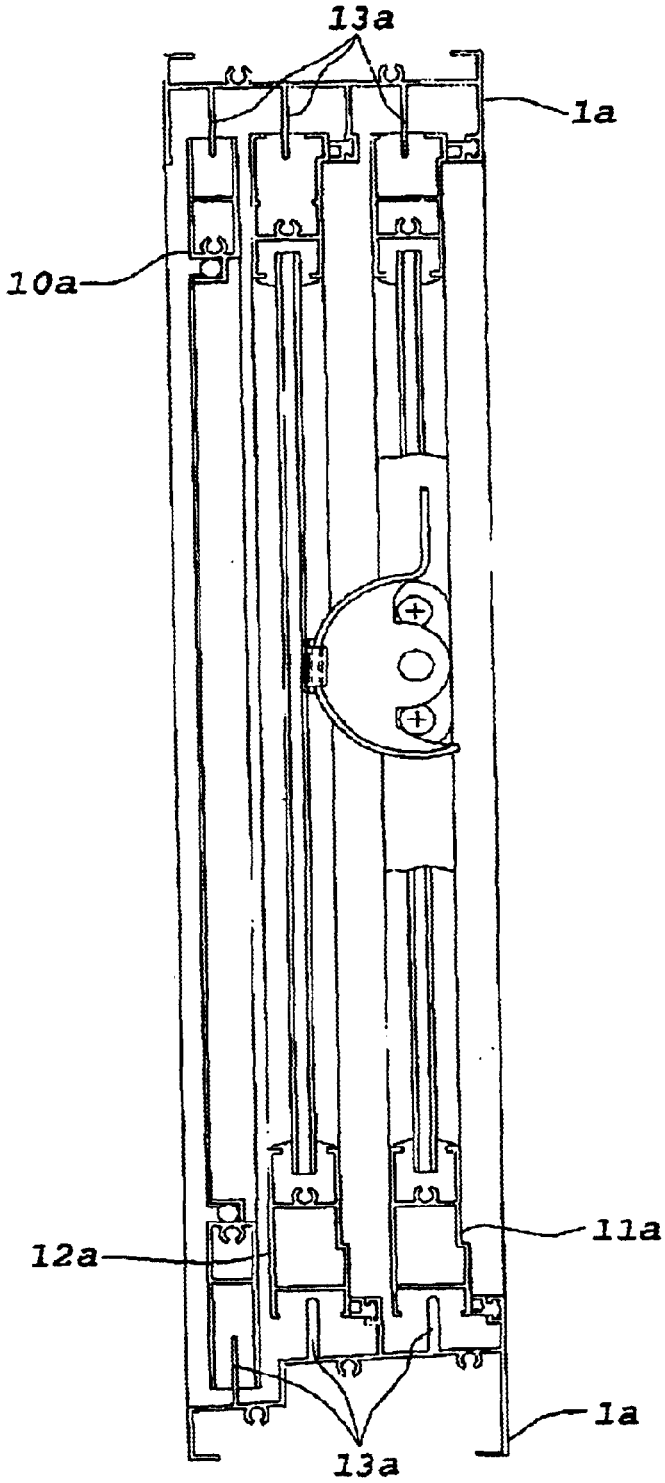
FIG. 1 PRIOR ART
FIG. 1 is a side view of a casement window known in the art.
Figure 2:
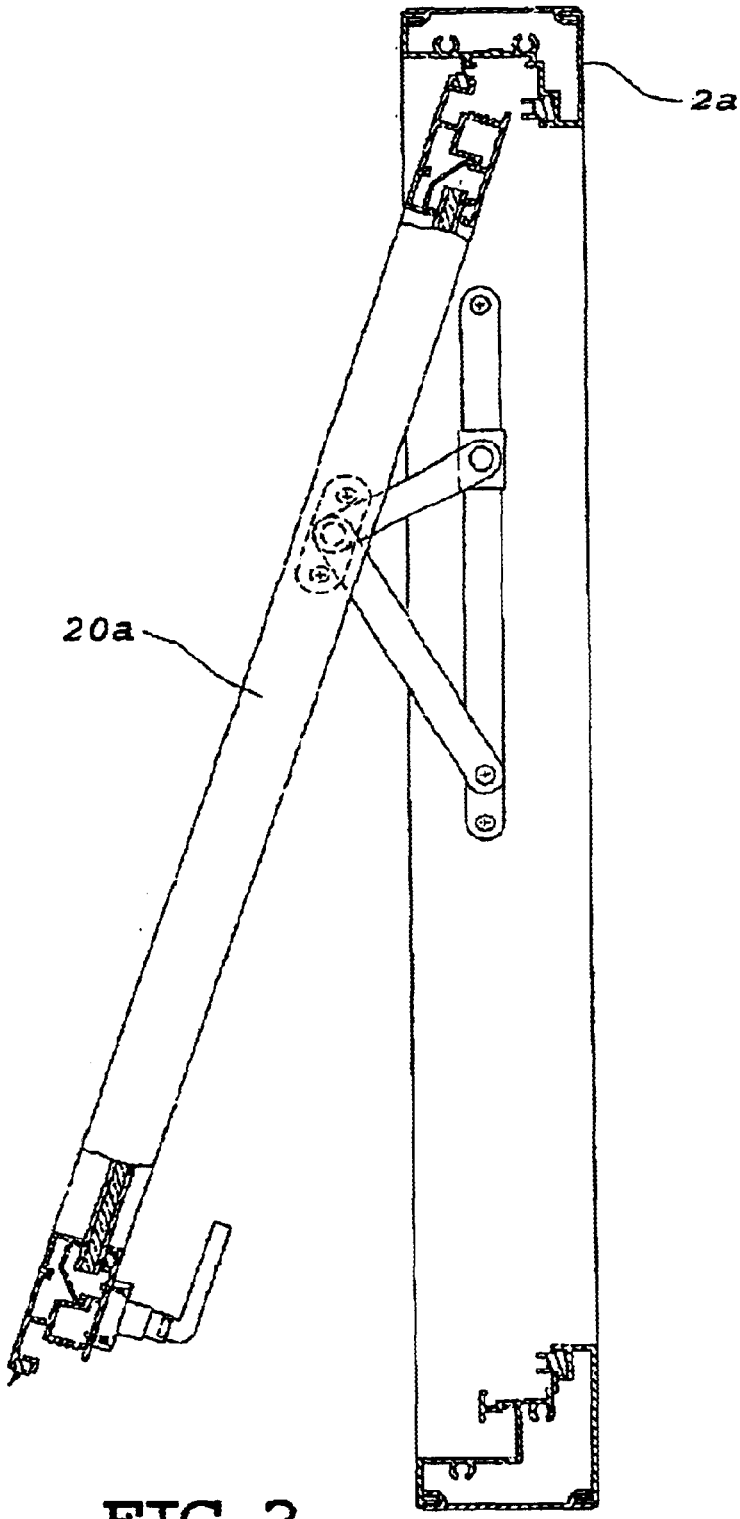
FIG. 2 PRIOR ART
FIG. 2 is a side view of a pivotably casement window known in the art.

The following detailed description of the invention with reference to the accompanying drawings is only illustrative of specific structures and ways of making the invention, and does not limit the scope of the invention. Wherever possible in the description, like reference numerals will refer to like elements and parts unless otherwise illustrated.

Figure 3:
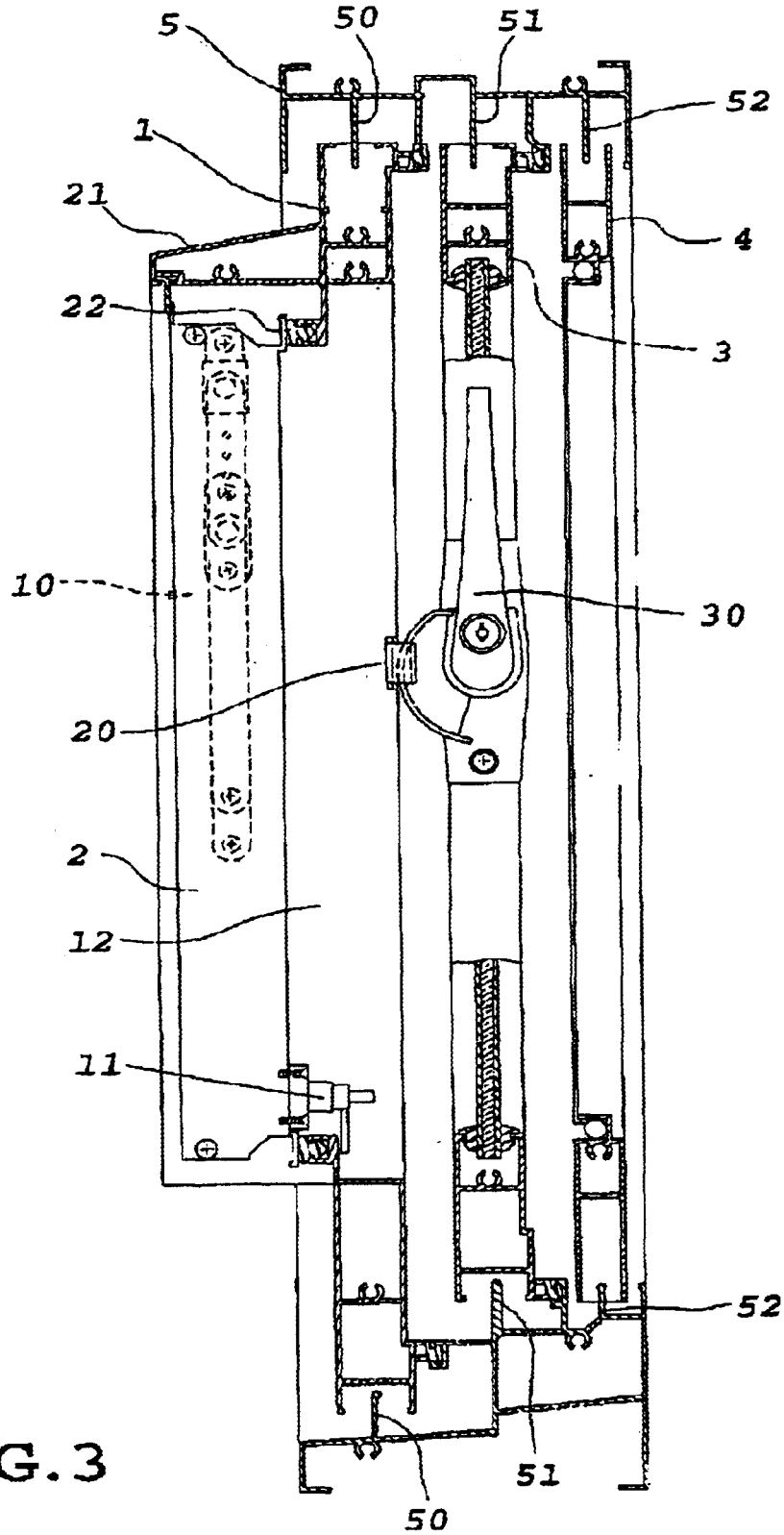
FIG. 3 is a side view of a dual casement window structure according to one embodiment of the invention.
Figure 4:
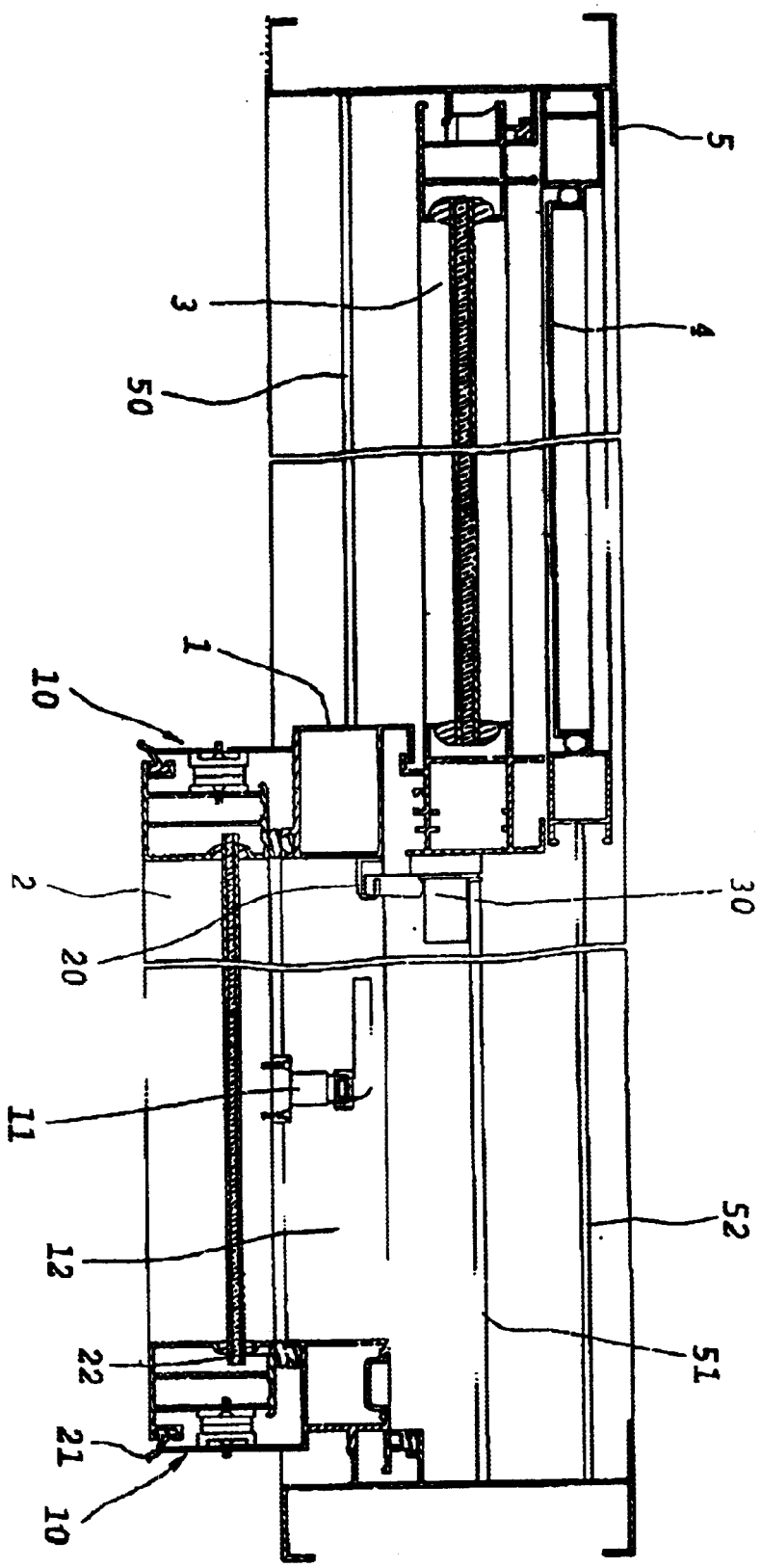
FIG. 4 is a top view of a dual casement window structure according to one embodiment of the invention.
Figure 6:
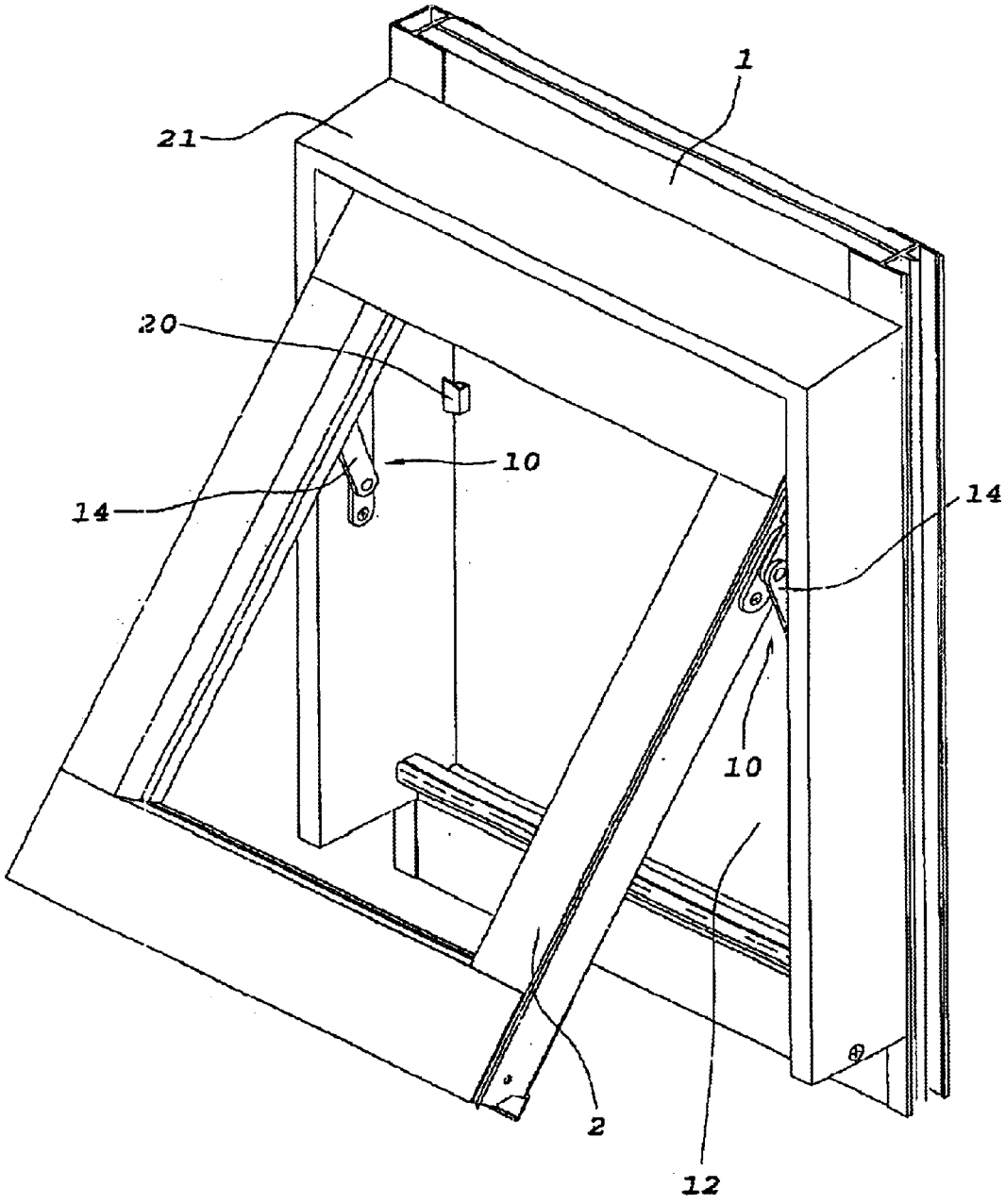
FIG. 6 is a perspective view illustrating the operation of a dual casement window structure according to one embodiment of the invention.

FIG. 3 is a side view of a dual casement window structure according to one embodiment of the invention. FIG. 4 is a top view of a dual casement window structure according to one embodiment of the invention. FIG. 6 is a perspective view illustrating the operation of a dual casement window according to one embodiment of the invention. The dual casement window structure includes a frame 5, a casement window 1, an outward opening window leaf 2 and a latch mechanism 11. The frame 5 is mounted in a wall of a house, and is provided with rails 50 at a top and a bottom of the frame 5. The casement window 1 is movably attached on the casement frame in a manner to slide along the rails 50. The casement window 1 has a mounting section 12 on its outer side. A room-side casement window 3 and a screen window 4 are further mounted in the casement frame 5 in a manner to respectively slide along rails 51, 52. The casement window 1 has a latch receptacle 20, and the room-side casement window 3 has a latch 30 corresponding to the latch receptacle 20 so that the latch 30 snaps the latch receptacle 20 when the casement window 1 is closed.

Figure 5:
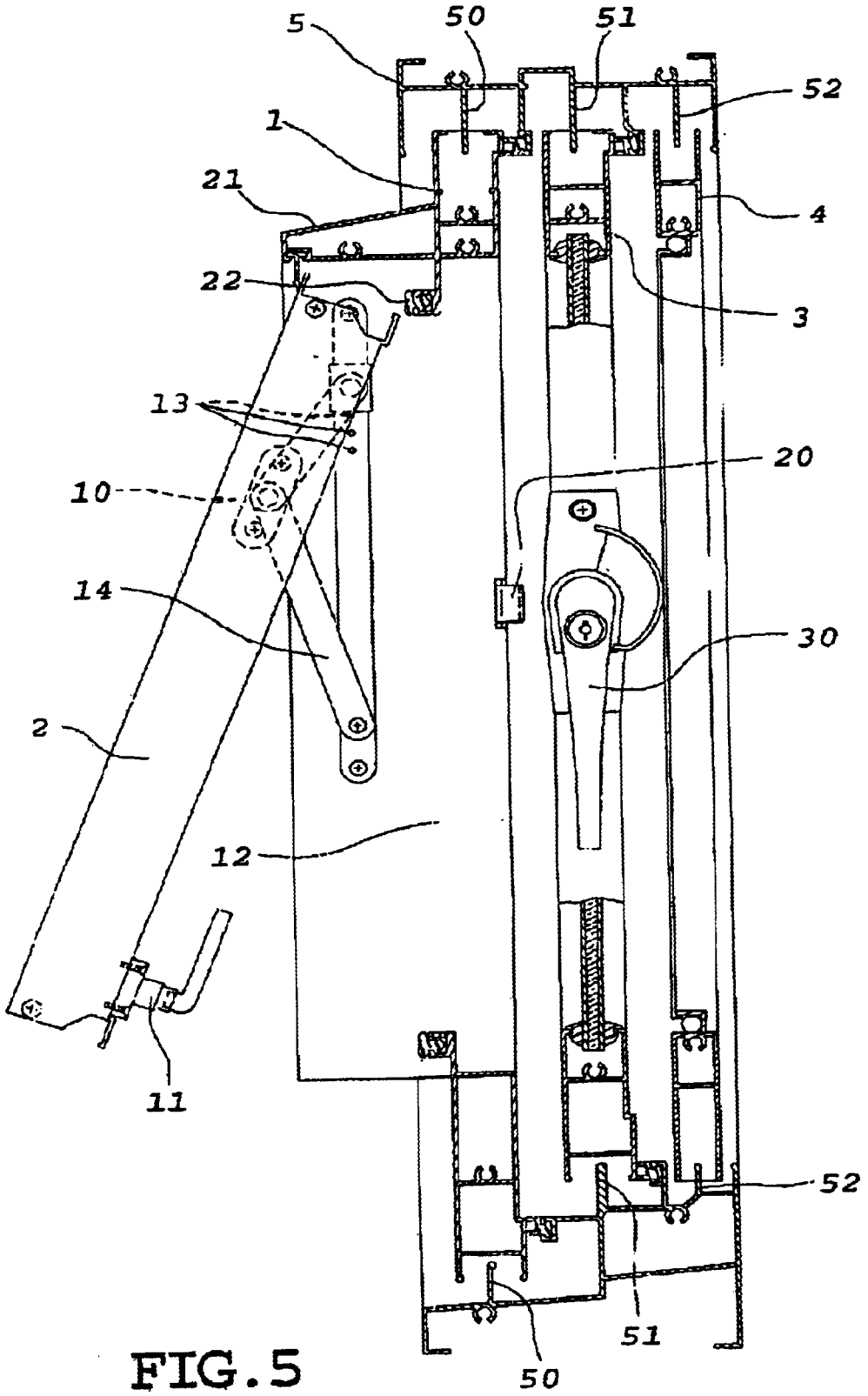
FIG. 5 is a side view illustrating the operation of a dual casement window structure according to one embodiment of the invention.

The outward opening window leaf 2 is mounted on the mounting section 12 of the casement window 1, and has a plurality of supporting means 10 to support the outward opening window leaf 2 when the outward opening window leaf 2 is pushed outwardly, as shown in FIG. 5. Each of the supporting means 10 has a plurality of positioning holes 13 and a plurality of supporting bars 14. A plurality of pins (not shown) are respectively inserted in the positioning holes 13 to properly limit the outward opening range of the outward opening window leaf 2. For example, a bottom of the outward opening window leaf 2 is located at a higher level than that of the casement window 1 by about 12 cm for preventing a small person such as a child from falling out. The structure of the supporting means 10 is well known in the art, and its description is omitted herein. The latch mechanism 11 is mounted at corresponding sides of the casement window 1 and outward opening window leaf 2.

The outward opening window leaf 2 is tightly attached to the casement window 1 in a closed state. A cushion 22 is mounted on the outward opening window leaf 2, where the outward opening window leaf 2 is in contact with the casement window 1 when it is closed. A sealing block 21 is further formed at an outer edge of the outward opening window leaf 2 to prevent rainwater from penetrating the room through a gap between the outward opening window leaf 2 and the casement window 1. Furthermore, since the outward opening window leaf 2 is pivotally connected to the casement window 1, the casement window 1 can be easily detached from the frame 5 for safely cleaning of the casement window 1 and outward opening window leaf 2 at the same time.

Figure 7:
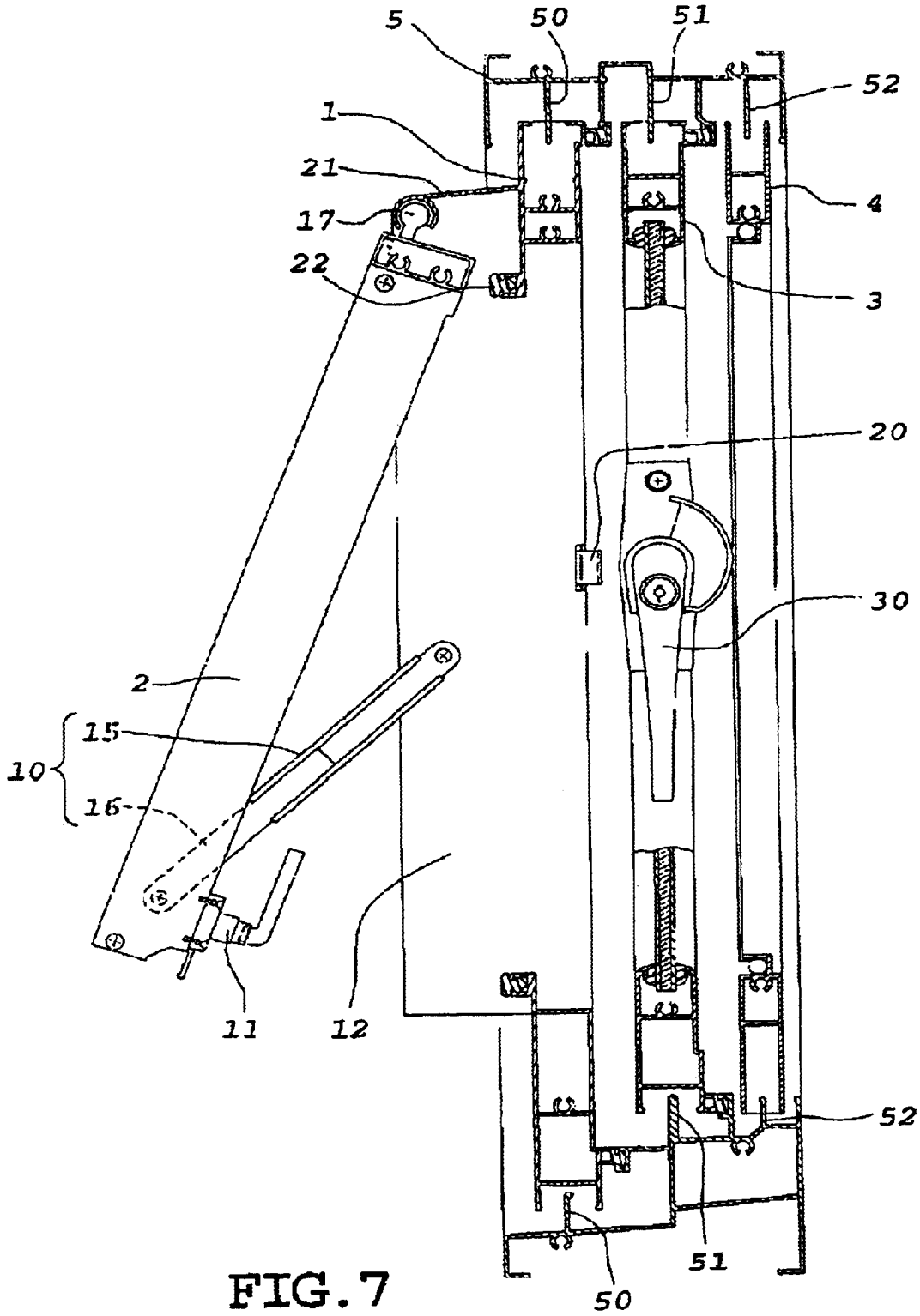
FIG. 7 is a side view illustrating the operation of a dual casement window structure according to another embodiment of the invention.
Figure 8:
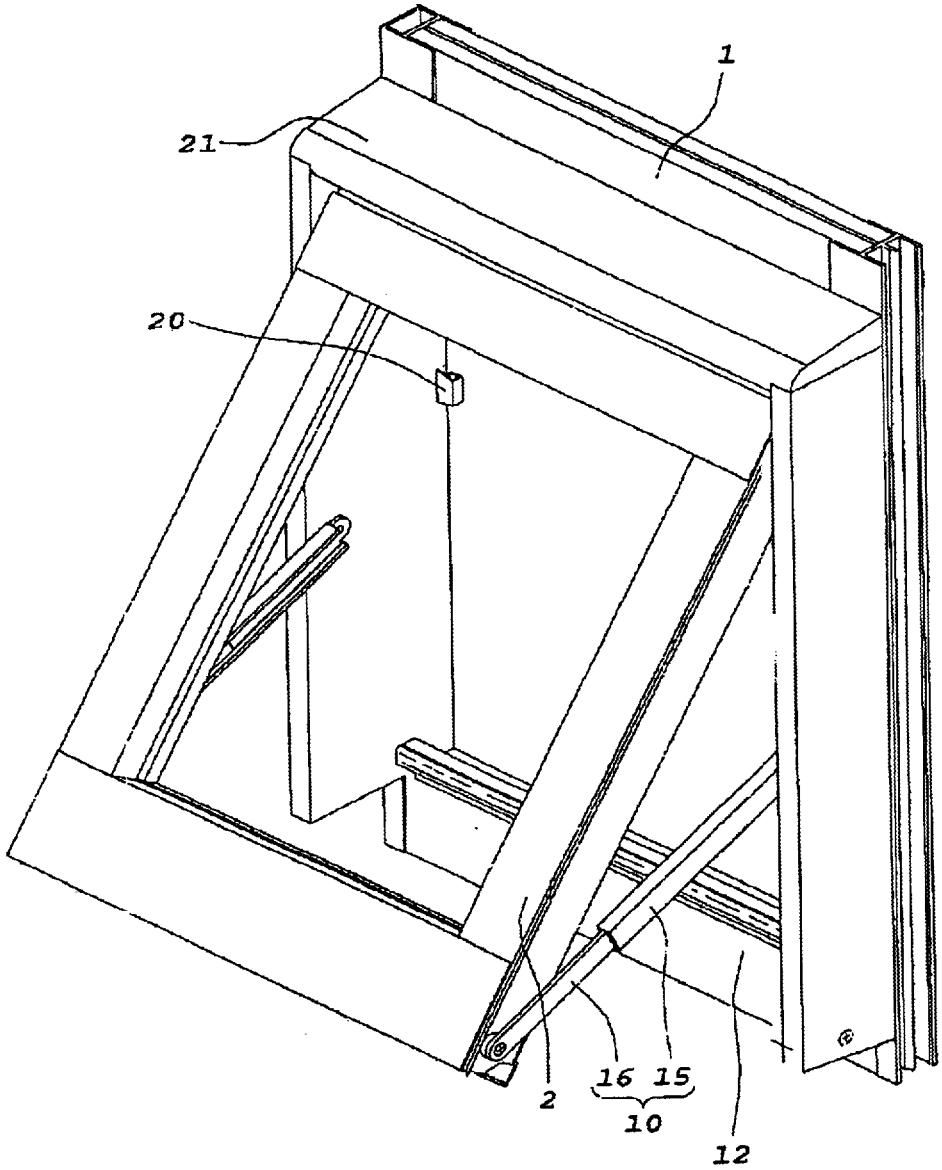
FIG. 8 is a perspective view illustrating the operation of a dual casement window structure according to another embodiment of the invention.

FIG. 7 is a side view illustrating the operation of a dual casement window structure according to another embodiment of the invention. FIG. 8 is a perspective view illustrating the operation of a dual casement window structure according to another embodiment of the invention. The outward opening window leaf 2 has a hinge 17 at its upper portion to pivotally connect the casement window 1. Each supporting means 10, in this embodiment, consists of a sliding rod 16 which is movably inserted into a sleeve 15.

In the dual casement window structure of the invention, the casement window 1 can move to a right side and a left side, and the outward opening window leaf 2 can provide improved ventilation. In rainy days, the casement window 1 can be closed while the outward opening window-leaf 2 remains opened, providing at the same time an improved ventilation and effective sheltering from rain water.

As described above, the invention therefore has the following advantages:

1. It is easy to install the dual casement window structure of the invention in the wall without additionally mounting a rain shelter.

2. By opening the outward opening window leaf 2, a good ventilation of the interior of the house can be maintained without the need of an air conditioner, thereby saving power consumption and achieving an environmental protection.

3. It is easy and safe to clean the casement window 1 and the outward opening window leaf 2 by detaching the casement window 1 from the frame 5.

4. A window with an iron grating, which usually may be additionally mounted outside the windows, is no longer needed with the dual casement window of the invention. Therefore, the dual casement window of the invention provides a safer escape way when fire accidents occur.

The casement window 1 and the outward opening window leaf 2 of the dual casement window structure of the invention are individually operated. The outward opening window leaf 2 can provide good air circulation in the interior of the room. The screen window 4 stops parasitic insects from entering the room. Furthermore, the outward opening window leaf 2 provides a safer escape way when fire accidents occur.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A dual casement window structure comprising:

a frame having a plurality of rails;

a casement window movably attached on the frame in a manner to slide along the rails, wherein the casement window has a mounting section on its outer side;

a window leaf mounted on the mounting section that opens toward said outer side, wherein said window leaf has a plurality of supporting means to support the outward opening window leaf and the supporting means having a sleeve receiving a sliding rod, and a hinge mounted at an upper portion of the leaf to pivotally connect the leaf to the window; and a latch mechanism mounted between the casement window and the outwardly opening window leaf.

2. The structure of claim 1, wherein a room-side casement window is further movably attached on the rails.

3. The structure of claim 2, wherein the casement window has a latch receptacle, and the room-side casement window has a latch corresponding to the latch receptacle.

4. The structure of claim 1, wherein a cushion is mounted on the outward opening window leaf, where the outward opening window leaf is in contact with the casement window when being closed.

5. The structure of claim 1, wherein a sealing block is further formed at an outer edge of the outward opening window leaf.

6. The structure of claim 1, wherein the supporting means has a plurality of supporting bars.

* * * * *